US005519406A

United States Patent [19]

Tsukamoto et al.

[11] Patent Number: 5,519,406

[45] Date of Patent: May 21, 1996

[54] LOW PROFILE POLARIZATION DIVERSITY PLANAR ANTENNA

[75] Inventors: Katsuya Tsukamoto, Hirakata; Naohisa Goto, Kawasaki; Hiroyuki Arai, Yokohama, all of Japan

[73] Assignee: Matsushita Electric Works, Ltd., Osaka, Japan

[21] Appl. No.: 389,648

[22] Filed: Feb. 16, 1995

[30] Foreign Application Priority Data

Mar. 9, 1994 [JP] Japan ..... 6-037996

[51] Int. Cl.[6] ..... H01Q 1/38; H01Q 13/10

[52] U.S. Cl. ..... 343/700 MS; 343/725; 343/770

[58] Field of Search ..... 343/700 MS, 702, 343/725, 767, 770, 846, 848; H01Q 1/38, 13/10

[56] References Cited

U.S. PATENT DOCUMENTS

| | | | |
|---|---|---|---|
| 4,903,033 | 2/1990 | Tsao et al. | 343/700 MS |
| 5,043,738 | 8/1991 | Shapiro et al. | 343/700 MS |
| 5,241,321 | 8/1993 | Tsao | 343/700 MS |
| 5,270,721 | 12/1993 | Tsukamoto et al. | 343/700 MS |
| 5,402,136 | 3/1995 | Goto et al. | 343/770 |
| 5,448,250 | 9/1995 | Day | 343/700 MS |
| 5,453,751 | 9/1995 | Tsukamoto et al. | 343/700 MS |

FOREIGN PATENT DOCUMENTS

| | | |
|---|---|---|
| 0605338 | 7/1994 | European Pat. Off. . |
| 2666691 | 3/1992 | France . |
| 5829203 | 2/1983 | Japan . |

OTHER PUBLICATIONS

42nd Vehicular Technology Society Conference, vol. 1, May 1992, Denver, Colorado, US pp. 29–32, H. Arai et al ' Flat diversity antenna at 900 Mhz for mobile telephone'.

IEEE Transactions on Vehicular Technology, vol. 40, No. 2, May 1991, "A Flat Energy Density Antenna System for Mobile Telephone" by Hiroyuki Arai, et al., pp. 483–486.

*Primary Examiner*—Donald T. Hajec
*Assistant Examiner*—Tan Ho
*Attorney, Agent, or Firm*—Watson Cole Stevens Davis

[57] ABSTRACT

A low profile polarization diversity planar antenna capable of effectively separating the horizontal and vertical polarization. The antenna combines a notch antenna (A) and a patch antenna (B) in a low profile structure. The notch antenna comprises a ground plate (10), a feed plate (20), and a radiator plate (30) which are stacked in a spaced relation. The radiator plate is shorted to the ground plate at its center and formed in its periphery with at least two radial notches (38). The feed plate carries feeder probes (27) each located adjacent to each one of the notches for feeding the notch antenna. The patch antenna comprises a patch (40) stacked above the radiator plate (30). The patch (40) is grounded at one portion thereof and has a feed point spaced from the grounded portion for feeding the patch antenna. The patch is grounded to the radiator plate and has a diameter smaller than the radiator plate. Thus, the notch antenna and the patch antenna have individual radiator elements with the radiator plate rendered as the ground plane for the patch antenna, the notch and patch antennas exhibit less mutual coupling so as to effectively separate horizontal polarization made by the notch antenna from vertical polarization by the patch antenna.

6 Claims, 6 Drawing Sheets

42
41
40
44
38
38
35
38
43
34
31
32
38
30
B 60
36
27
17
29
21
25
20
37
27
27
24
22
28
29
26
28
27
A
50
15
10
16
11
12
13
14
71
81
72
80
70
82
73
83
75
85

LOW PROFILE POLARIZATION DIVERSITY PLANAR ANTENNA

BACKGROUND OF THE INVENTION

1. Field of the Invention

The present invention is directed to a low profile polarization diversity planar antenna for communicating polarized radiation in broad frequency band, particularly suited for a relay antenna or cellular antenna in a mobile telephone system.

2. Description of the Prior Art

In accordance with increasing demands for miniaturizing space diversity antenna for mobile telephone system, it has been proposed to give a combination of a notch antenna and a patch antenna, as disclosed in the paper "A Flat Energy Density Antenna System for Mobile Telephone", IEEE Transactions on Vehicular Technology, Vol. 40, No. 2, May 1991 by Hiroyuki Arai, Hideki Iwashita, Nasahiro Toki, and Naohisa Goto. The proposed antenna comprises a ground plane, a patch with notches, and a feed plate carrying microstrip lines. The patch has a feed point at its center and is shorted to the ground plane at portions spaced radially away from the center so that the patch is cooperative with the ground plane to constitute the patch antenna responsible for vertical polarization with respect to the ground plane. The microstrip lines of the feed plate include feed lines which are located in a directly opposed relation to the individual notches in the patch in order to feed the resulting notch antenna responsible for horizontal polarization with respect to the ground plane. However, in this composite antenna where the patch is commonly used as a radiator element for the notch and patch antennas, mutual coupling between the notch and patch antennas remains great so as to make it difficult to separate horizontal and vertical polarization effectively.

SUMMARY OF THE INVENTION

The above problem has been eliminated in the present invention which provides a low profile polarization diversity planar antenna which is capable of effectively separating the horizontal and vertical polarization, yet with a low profile structure. The antenna in accordance with the present invention comprises a notch antenna (A) and a patch antenna (B). The notch antenna (A) comprises a ground plate (10), a feed plate (20), and a radiator plate (30) which are stacked in a spaced relation. The radiator plate (30) is shorted to the ground plate (10) and formed in its periphery with at least two radial notches (38). The feed plate (20) is provided with feeder probes (27) each located adjacent to each one of the notches (38) for feeding the notch antenna (A). The patch antenna (B) comprises a patch (40) stacked above the radiator plate (30). The patch (40) is grounded at one portion thereof and has a feed point spaced from the grounded portion for feeding the patch antenna. The patch is grounded to the radiator plate and has a diameter smaller than the radiator plate. Thus, the notch antenna and the patch antenna have individual radiator elements with the radiator plate rendered as the ground plane for the patch antenna, the notch and patch antennas exhibit less mutual coupling so as to effectively separate horizontal polarization made by the notch antenna from vertical polarization by the patch antenna.

Accordingly, it is a primary object of the present invention to provide a low profile polarization diversity flat antenna which is capable of reducing mutual coupling between the notch and patch antenna for effectively separating the horizontal polarization from the vertical polarization.

In a preferred embodiment, the radiator plate (30) is formed with four radial notches (38) which are spaced circumferentially evenly. The feeder probes (27) are arranged to extend within a plane of the feed plate (20) in such a manner as to cross with the corresponding notches (38) at an angle of 90°. The feeder probes (27) are connected through microstrip lines (28) to a common feed point at the center of the feed plate (20). With thus equiangularly disposed four notches and the corresponding feeder probes, the notch antenna can provide non-directional horizontal polarization, which is therefore another object of the present invention.

The patch is supported to the ground plate by means of at least one shortening post (75) which extends through the feed plate (20) and through radiator plate (30) with the post electrically connected to the radiator plate at such a portion not to substantially influence the notch antenna characteristics. Thus, the radiator plate can serve as the ground plane for the patch antenna.

The patch and the radiator plate are made of an electrically conducive metal and are stacked together with the ground plate in this order from top to bottom with insulation layers disposed between the adjacent ones of the ground plate, said feed plate, the radiator plate, and the patch. The insulation layers may be foam plastics or air so that assembly of the antenna can be readily made simply by stacking these components one on the other.

The antenna of the present invention can be utilized to provide levorotatory and dextrorotatory circular polarization circular polarization selectively when including a feed circuit which feeds the notch antenna and the patch antenna with a phase difference of 90°, which is therefore a further object of the present invention.

These and still other objects and advantageous features of the present invention will become more apparent from the detailed description of the following embodiment when taken in conjunction with the attached drawings.

DETAILED DESCRIPTION OF THE EMBODIMENT

Figure 1:
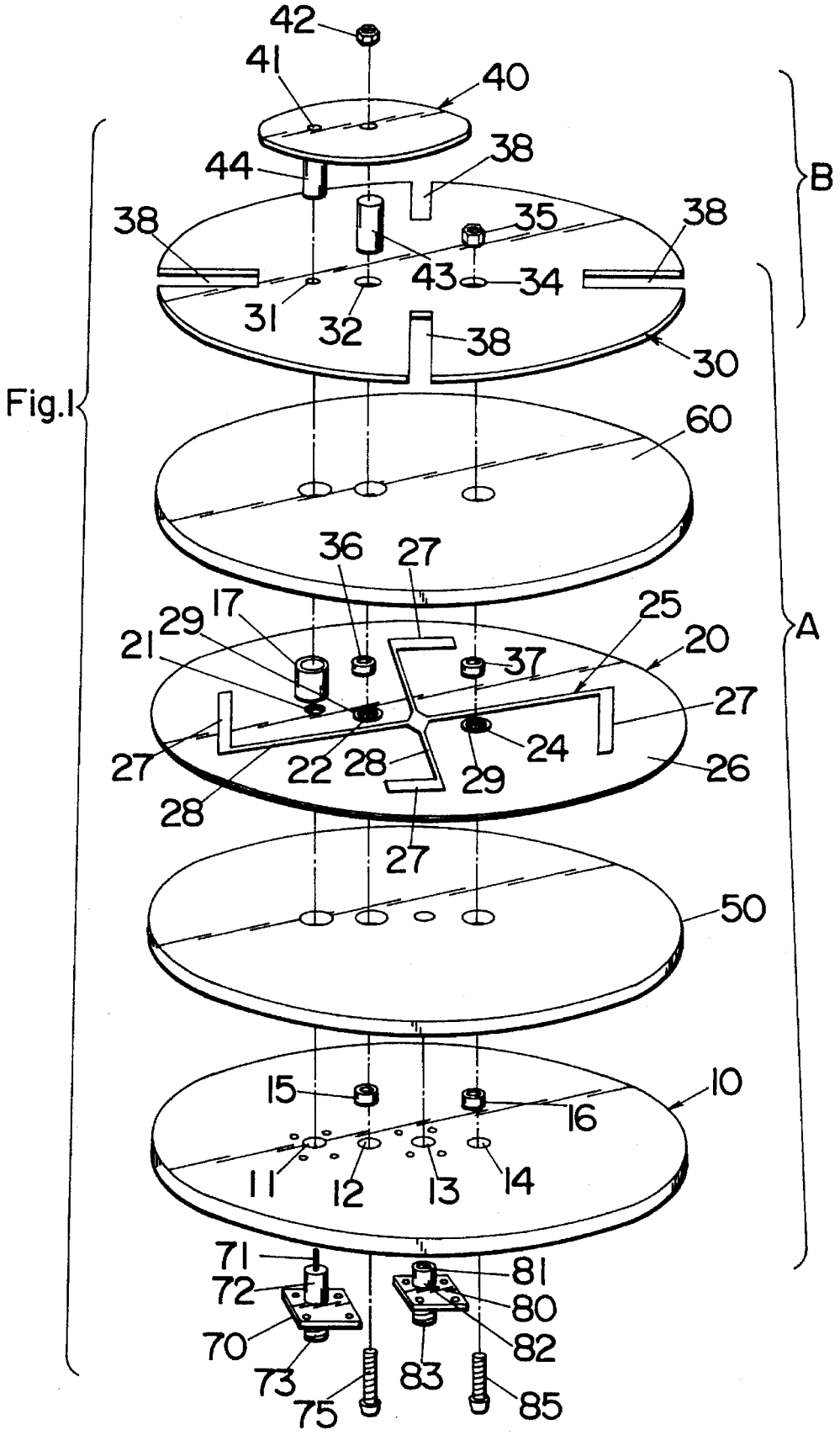
FIG. 1 is an exploded perspective view of a low profile diversity polarization planar antenna assembly in accordance with a preferred embodiment of the present invention.
Figure 2:
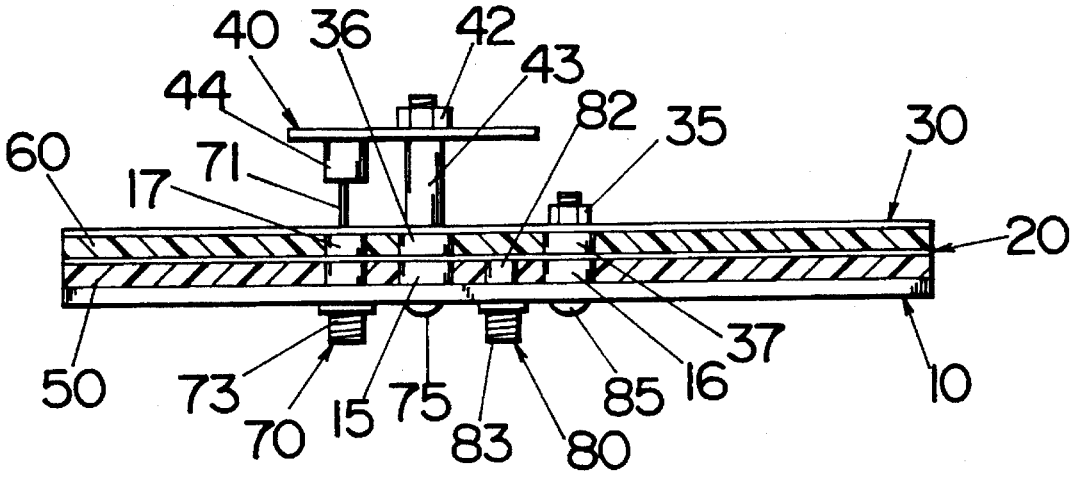
FIG. 2 is a sectional view of the antenna assembly.

Referring now to FIGS. 1 and 2, there is shown a low profile polarization diversity planar antenna assembly in accordance with a preferred embodiment of the present invention. The antenna assembly comprises a ground plate 10, a feed plate 20, a radiator plate 30, and a patch 40 which are stacked in a spaced relation with a dielectric foam plastic sheet 50 interposed between the ground plate 10 and the feed plate 20 and with another foam plastic sheet 60 interposed between the feed plate 20 and the radiator plate 30. The ground plate 10, feed plate 20, radiator plate 30, patch 40 and foam plastic sheets 50 and 60 are shaped into a circular configuration. The ground plate 10 and the radiator plate 30 are struck from 2 mm thick and 0.5 mm thick aluminum sheets to have 140 mm and 130 mm diameters, respectively, while the foam plastic sheets 50 and 60 are cut from a 2 mm thick sheet so as to make the antenna for 1.35 GHz use. The patch 40 is struck from a 0.5 mm thick aluminum sheet to have a 37 mm diameter. The feed plate 20 comprises a printed conductor pattern 25 etched on a lower surface of a flexible dielectric plastic film 26 of the same diameter of the radiator plate 30.

The ground plate 10 is formed with four holes 11 to 14 which are aligned along a diameter of the plate with one hole 13 at a geometrical center of the plate. Connectors (commercially available as SMA type connector) 70 and 80 are secured to the ground plate 10 with individual center conductors 71 and 81 extending through first and third holes 11 and 13, respectively as being insulated from the ground plate 10 by individual sleeves 72 and 82. Outer conductors 73 and 83 of the connectors 70 and 80 form respective threaded barrels which are electrically connected to the ground plate 10. The center conductor 71 of the connector 70 extends further through foam plastic 50, a hole 21 of feed plate 20, foam plastic 60, and a hole 31 of radiator plate 30 for connection to a feed point 41 of the patch 40, while the center conductor 81 of the connector 80 extends through the lower foam plastic 50 for electrical connection to a center of the printed pattern 25 on the feed plate 20. Extending though the second hole 12 of the ground plate 10 is a screws 75 which further extends through foam plastic sheet 50, a hole 22 of feed plate 20, foam plastic sheet 60, and a hole 32 of radiator plate 30 so as to be connected by a nut 42 to a geometrical center of the patch 40 for supporting the patch 40 and the intermediate members to the ground plate 10. A conductive tube 43 is fitted around the screw 75 between the patch 40 and the radiator plate 30 for shortening the center of the patch 40 to an offset center of the radiator plate 30. Another screw 85 extending through the fourth hole 14, the lower foam plastic sheet 50, a hole 24 of feed plate 20, the upper foam plastic sheet 60, and a hole 34 of the radiator plate 30 so as to be secured by a nut 35 for supporting the radiator plate 30 and the intermediate members to the ground plate 10. In order to space the feed plate 20 from the ground plate 10 by a fixed distance, spacers 15 and 16 are fitted around the screws 75 and 85 between the ground plate 10 and the feed plate 20. Also spacers 36 and 37 are fitted around the screws 75 and 85 between the feed plate 20 and the radiator plate 30 in order to held the radiator plate 30 at a fixed distance from the feed plate 20 as well as from the ground plate 10. A conductive tube 17 is fitted around the sleeve 72 of the connector 70 between the ground plate 10 and the radiator plate 30 such that the radiator plate 30 is shorted to the ground plate 10 also through the tube 17 as well as through the screws 75 and 85 with associated spacers 15, 16, 36, and 37. In this manner, the tube 17, screws 75 and 85 and the spacers 15, 16, 36, and 37 constitute shortening posts for shortening the center portion of the radiator plate 30 to the ground plate 10. Likewise, tube 43 and screw 75 constitute a shortening post for shortening the center of the patch 40 to the radiator plate 30.

The radiator plate 30 is formed with four radial notches 38 which extend in a radial direction and open to the periphery of the plate 30. The radial notches 38 are circumferentially spaced evenly, i.e., by an angle of 90°. In correspondence with the four notches 38, the printed conductor pattern 25 on the feed plate 20 has four feeder probes 27 which extend in such a manner as to cross perpendicularly with the corresponding notches 38 for feeding a notch antenna (A) composed of the radiator plate 30, the ground plate 10, and the associated shortening posts. The feeder probes 27 are connected commonly to the center of the conductive pattern 25 through microstrip lines 28. The feeder probe 27 is configured to have 5 mm width and 45 mm length. It is this common center against which the center conductor 81 abuts at its top end for electrical connection between the connector 80 and the feeder probes 27. In addition, the feed plate 20 is formed around the holes 22 and 24 respectively with ring lands 29 which are each etched on the opposite surfaces of the film 26 to be continuous between the opposite surfaces. The lands 29 are held between the spacers 15 and 36 and between the spacers 16 and 37, respectively for reliable electrical interconnection therebetween.

The center conductor 71 of the connector 70 is connected to the feed point 41 of the patch 40 through a matching element 44 to feed a patch antenna (B) composed of the patch 40, the radiator plate 30 as a ground plane, and the shortening post 43. The feed point 41 is spaced radially from the shorted center of the patch 40 by as less as $\lambda/15$ due to the structure of shortening the center of the patch 40, in contrast to a structure in which a patch has a center feed point and shorted offset from the center where a distance of $\lambda/4$ is required between the feed point and the shortening point. The center conductor 71 may be directly connected to the patch while eliminating the matching element 44.

In the manner as described in the above, the notch antenna and the patch antenna are formed into a flat unitary structure to give a polarization diversity antenna system where the notch antenna is responsible for horizontal polarization with respect to the plane of the ground plate and the patch antenna is responsible for vertical polarization.

Figure 3:
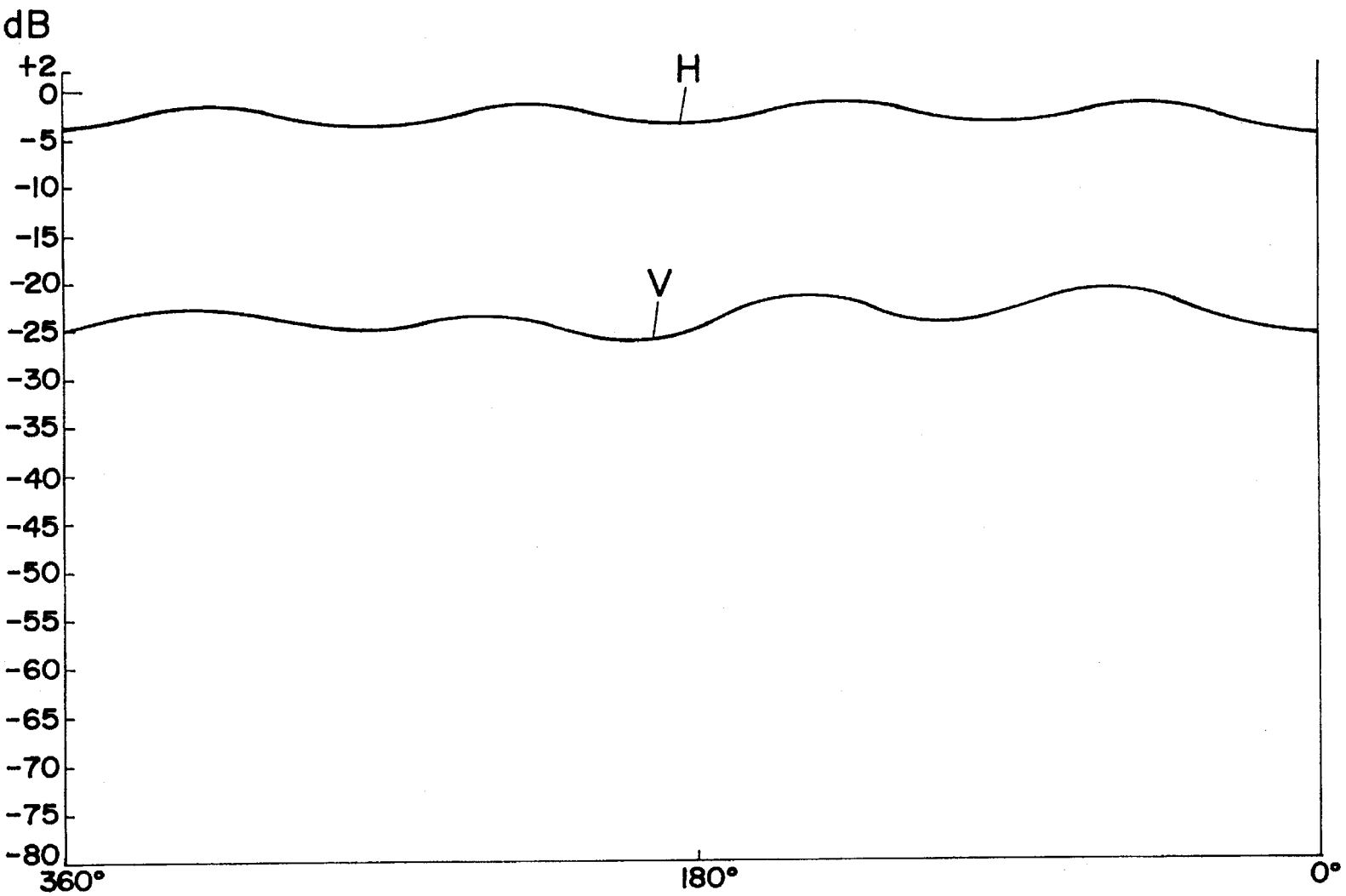
FIG. 3 is a graph illustrating directivity characteristic of a notch antenna included in the assembly.
Figure 4:
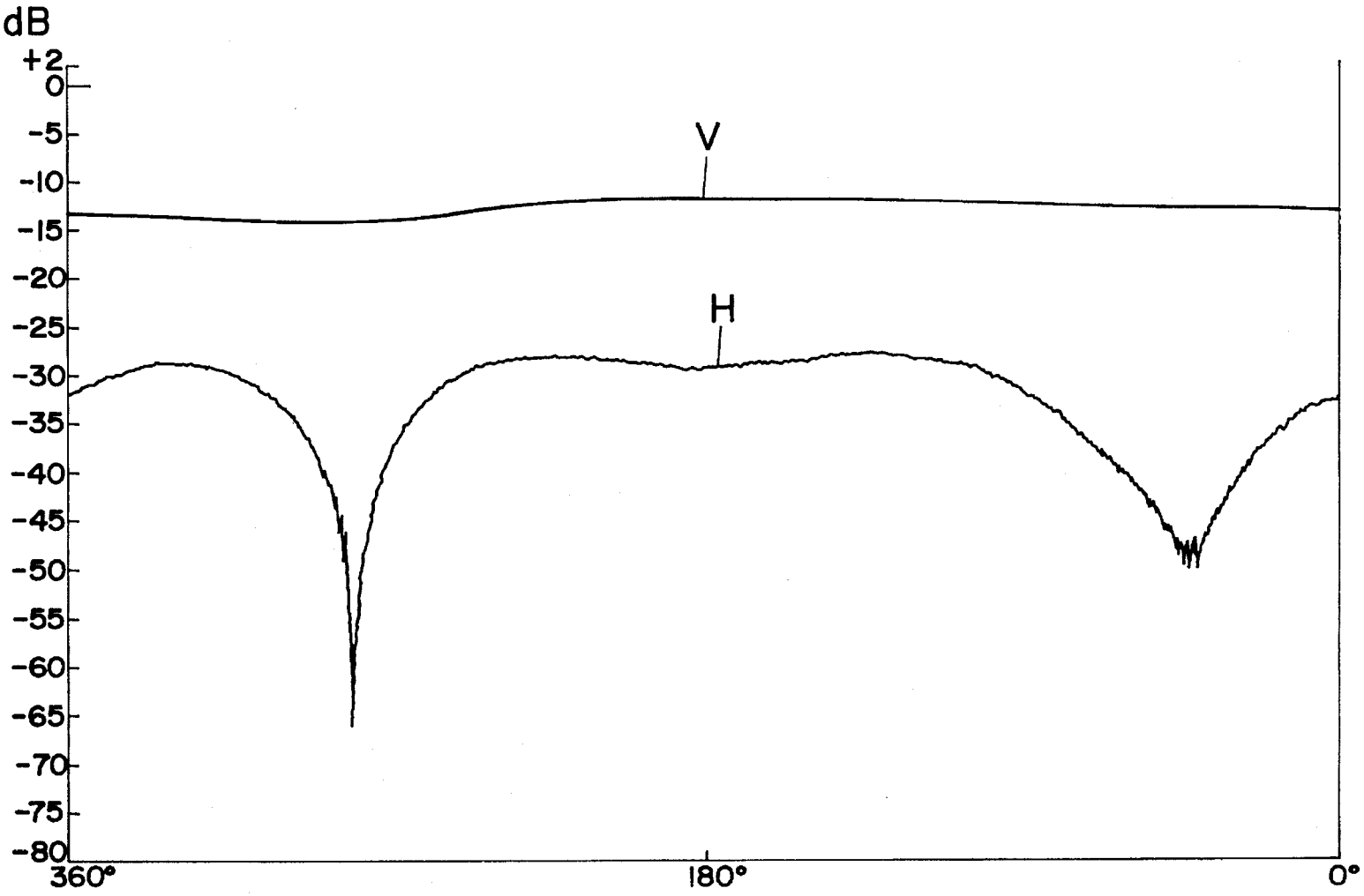
FIG. 4 is a graph illustrating directivity characteristic of a patch antenna included in the assembly.

Antenna characteristics of thus assembled antenna system were tested at a frequency of 1.35 GHz with regard to directivity of horizontal polarization for the notch antenna (FIG. 3) and directivity of vertical polarization for the patch antenna (FIG. 4). As seen from FIG. 3, it is confirmed that substantially uniform radiation power (H) of horizontal polarization is obtained over 360° range for the notch antenna to assure non-directivity, while radiation power (V) of the cross polarization (vertical polarization) is reduced to as less as 20 dB. For the patch antenna, it is also confirmed from FIG. 4 that substantially uniform radiation power (V) of vertical polarization is obtained over 360° range to assure non-directivity, while radiation power (H) of the cross polarization (horizontal polarization) is reduced to as less as 20 dB.

Although, in the above embodiment, the notch antenna (A) is actuated by the use of a feed circuit which energize four feeder probes 27 equally for feeding four notches 38, it is possible to energize only a diagonally opposed pair of the feeder probes 27 for feeding one the corresponding pair of the notches 38, while leaving the other pair of the notches 38 not to be fed. In this instance, the unfed pair of notches constitute parasitic element for obtaining a desired antenna characteristic.

Figure 5:
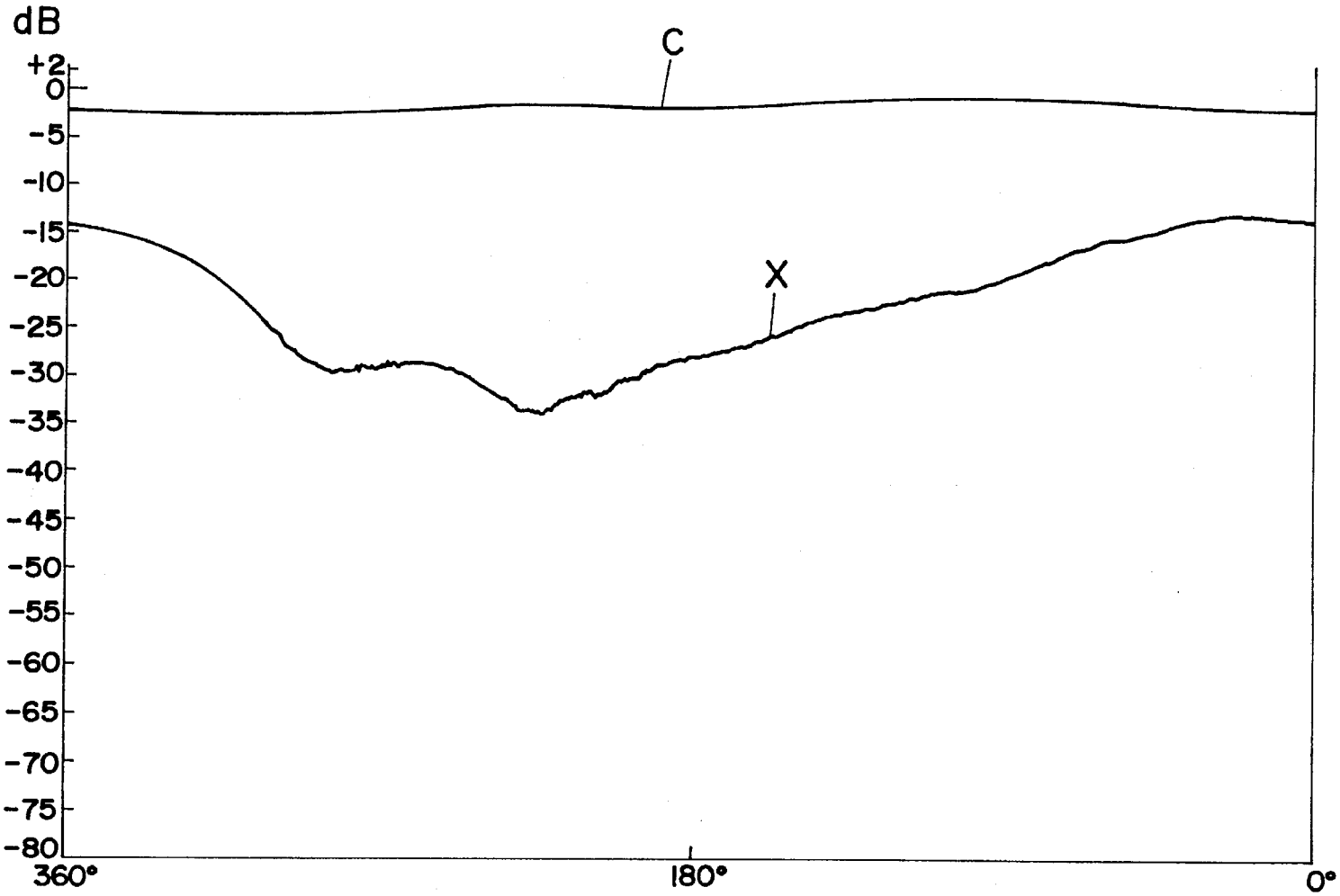
FIG. 5 is a graph illustrating directivity characteristic of the antenna when utilized to provide circular polarization.

The above antenna structure can be well adapted for use to provide circular polarization with the use of a feeder circuit (not shown) which feeds the notch antenna and the patch antenna by a phase difference of 90°. A test was made to measure radiation power for the antenna when providing the circular polarization at a frequency of 1.35 GHz. The result is illustrated in FIG. 5, from which it is confirmed that circular polarization of uniform radiation power (C) is obtained over 360° range to assure non-directivity, with reduced cross polarization (X) is considerably reduced. The feeder circuit is preferred configured to be capable of selectively give levorotatory and dextrorotatory circular polarization.

Figure 6:
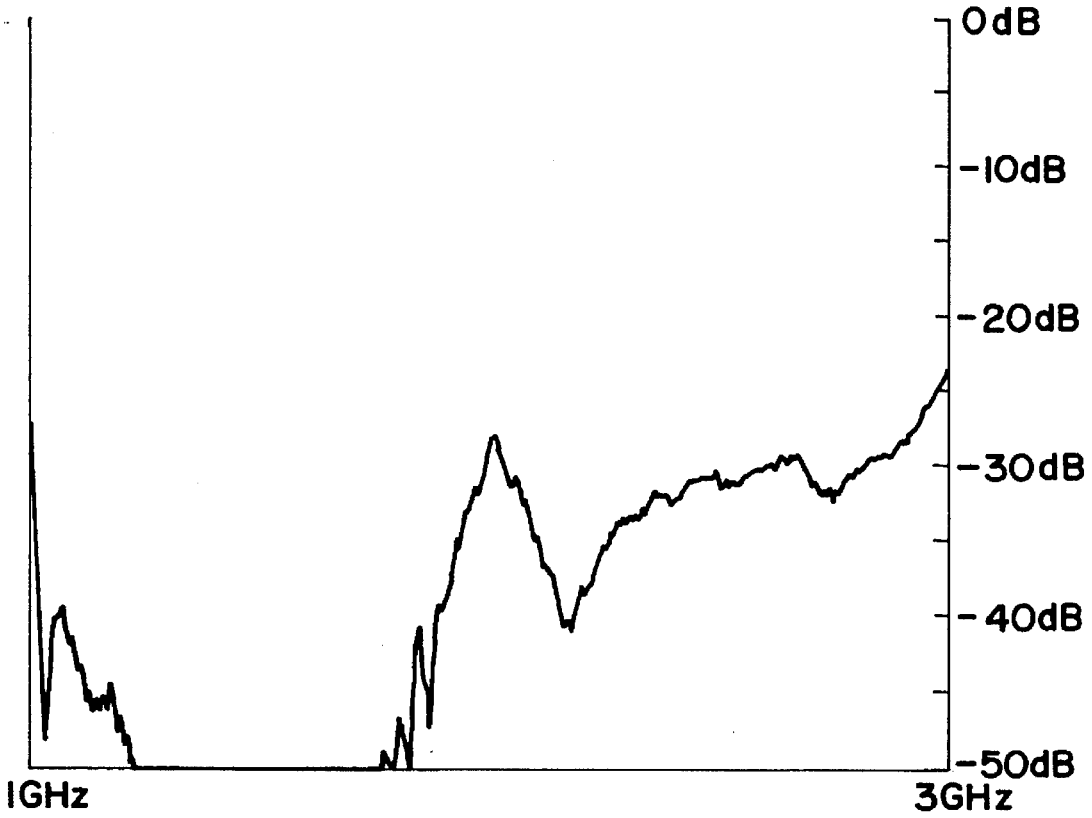
FIG. 6 is a graph illustrating isolation characteristic between feed terminals of the notch and patch antennas.

Further, it was tested to evaluate isolation between the connectors 70 and 80. The result is shown in FIG. 6 from which it is seen that isolation of more than 20 dB is obtained over a wide frequency range of 1 to 3 GHz, which confirm independence between the notch and patch antennas.

What is claimed is:

1. A low-profile polarization diversity planar antenna which comprises:

a notch antenna comprising: a ground plate, a feed plate, and a radiator plate are which are stacked in a spaced relation, said radiator plate being shorted to said ground plate and formed in its periphery with at least two radial notches, said feed plate provided with feeder probes each located adjacent to each one of said notches for feeding said notch antenna; and a patch antenna comprising: a patch stacked above said radiator plate, said patch grounded at one portion of said patch and having a feed point spaced from the grounded portion for feeding said patch antenna;

wherein said patch is grounded to said radiator plate and has a diameter smaller than said radiator plate.

2. A polarization diversity planar antenna as set forth in claim 1, wherein said radiator plate is formed with four said radial notches which are spaced circumferentially evenly, and wherein said feeder probes are arranged to extend within a plane of said feed plate in such a manner as to cross with the corresponding notches at an angle of 90°, said feeder probes being connected through microstrip lines to a common feed point at the center of said feed plate.

3. A polarization diversity planar antenna as set forth in claim 2, including a feed circuit which energizes only one diagonally opposed pair of said feeder probes for feeding the corresponding pair of said notches, while leaving the other pair of said notches not to be fed.

4. A polarization diversity planar antenna as set forth in claim 1, wherein said patch is supported to said ground plate by means of at least one shortening post which extends through said feed plate and through said radiator plate with said post electrically connected to said radiator plate.

5. A polarization diversity planar antenna as set forth in claim 1, wherein said radiator plate and said patch are made of an electrically conducive metal and wherein said ground plate, said feed plate, said radiator plate, and said patch are stacked in this order from bottom to top with insulation layers disposed between the adjacent ones of said ground plate, said feed plate, said radiator plate, and said patch.

6. A planar antenna as set forth in claim 1, further including a feed circuit for feeding said notch antenna and said patch antenna with a phase difference of 90° so as to selectively give levorotatory and dextrorotatory circular polarization.

* * * * *